US008165336B2

(12) United States Patent
Iino et al.

(10) Patent No.: US 8,165,336 B2
(45) Date of Patent: Apr. 24, 2012

(54) VOICE COIL AND SPEAKER

(75) Inventors: Junji Iino, Gunma-ken (JP); Shinji Kamimura, Gunma-ken (JP); Satoshi Imamura, Gunma-ken (JP)

(73) Assignee: Victor Company of Japan, Limited, Yokohama (JP)

( * ) Notice: Subject to any disclaimer, the term of this patent is extended or adjusted under 35 U.S.C. 154(b) by 608 days.

(21) Appl. No.: 12/379,059

(22) Filed: Feb. 11, 2009

(65) Prior Publication Data

US 2009/0202100 A1 Aug. 13, 2009

(30) Foreign Application Priority Data

Feb. 12, 2008 (JP) ..... P2008-030841

(51) Int. Cl.
*H04R 9/06* (2006.01)

(52) U.S. Cl. ..... 381/407; 381/397

(58) Field of Classification Search ..... 381/397, 381/407

See application file for complete search history.

(56) References Cited

U.S. PATENT DOCUMENTS

| | | | | |
|---|---|---|---|---|
| 4,163,876 | A * | 8/1979 | Ohnuki | 381/347 |
| 4,313,040 | A * | 1/1982 | Tsukamoto | 381/425 |
| 5,027,412 | A * | 6/1991 | Hayashi et al. | 381/409 |
| 5,249,236 | A * | 9/1993 | Sakamoto | 381/409 |
| 5,717,775 | A * | 2/1998 | Sakamoto et al. | 381/400 |
| 5,757,935 | A * | 5/1998 | Kang et al. | 381/326 |
| 5,828,767 | A * | 10/1998 | Button | 381/401 |
| 5,875,253 | A * | 2/1999 | Okazaki et al. | 381/396 |
| 6,587,571 | B1 * | 7/2003 | Fujihira et al. | 381/407 |
| 6,661,903 | B1 * | 12/2003 | Tamura et al. | 381/423 |
| 7,676,053 | B2 * | 3/2010 | Nagaoka | 381/414 |
| 7,684,585 | B2 * | 3/2010 | Kemmerer | 381/397 |
| 7,706,563 | B2 * | 4/2010 | Stewart | 381/421 |
| 7,831,059 | B1 * | 11/2010 | Sahyoun | 381/397 |
| 2003/0118207 | A1 * | 6/2003 | Kudo | 381/397 |
| 2003/0156732 | A1 * | 8/2003 | Hong | 381/409 |
| 2004/0062415 | A1 * | 4/2004 | Suzuki | 381/407 |
| 2006/0039578 | A1 * | 2/2006 | Stiles et al. | 381/400 |
| 2006/0098839 | A1 * | 5/2006 | Ishigaki et al. | 381/400 |
| 2007/0223775 | A1 * | 9/2007 | Sugiura | 381/407 |

FOREIGN PATENT DOCUMENTS

| | | |
|---|---|---|
| JP | 01-2223898 | 9/1989 |
| JP | 4-273697 A | 9/1992 |
| JP | 06-284498 | 10/1994 |
| JP | 08-205285 A | 8/1996 |
| JP | 11-341596 | 12/1999 |
| JP | 2002-300697 | 10/2002 |
| JP | 2007-243659 A | 9/2007 |

OTHER PUBLICATIONS

Office Action issued on Sep. 6, 2010 in the counterpart Korean Application, four (4) pages.

Office Action issued on Aug. 15, 2011 in the counterpart Chinese application.

* cited by examiner

*Primary Examiner* — Charles Garber
*Assistant Examiner* — Yasser Abdelaziez
(74) *Attorney, Agent, or Firm* — The Nath Law Group; Jerald L. Meyer; Stanley N. Protigal

(57) ABSTRACT

A voice coil includes a cylindrical bobbin formed of a first material; a coil which surrounds on an outer circumferential surface of the bobbin; and a plurality of reinforcement members formed of a material having a propagation speed faster than the first material and provided on the outer circumferential surface of the cylindrical bobbin.

10 Claims, 4 Drawing Sheets

VOICE COIL AND SPEAKER

CROSS REFERENCE TO RELATED APPLICATIONS

This application is based upon and claims the benefit of priority from the prior Japanese Patent Applications No. P2008-030841 filed on Feb. 12, 2008; the entire contents of which are incorporated herein by reference.

BACKGROUND OF THE INVENTION

1. Field of the Invention

The present invention relates to a voice coil having a bobbin and a coil, and a speaker including the voice coil.

2. Description of the Related Art

In a dynamic speaker, a bobbin is vibrated by a change of a current flowing through a coil wound around a bobbin, and vibrations thus generated are transmitted to a diaphragm. Accordingly, as a material that forms the bobbin of the voice coil, it is preferable to select a material that easily transmits vibrations to the diaphragm, are lightweight and strong.

Various materials such as kraft, aluminum, aramid fiber and polyimide have been used for a conventional voice coil bobbin (for example, Japanese Unexamined Patent Application Laid-Open (Koukai) No. 2002-300697). However, the conventional materials have merits and demerits and there have not been obtained yet a single material for a voice coil bobbin which has a high propagation velocity, is lightweight and strong, and is capable of suppressing its vibration loss smaller.

In addition, there have been proposed that a voice coil bobbin on which a metallic layer is deposited on an entire surface of a resin film base (for example, Japanese Unexamined Patent Application Laid-open (Koukai) No. H11-341596). However, the voice coil bobbin on which the metallic layer is deposited is unsuitable for voice coil bobbins of a full-range and mid/treble speakers because the metallic layer deposited on the entire surface of the resin film base increases a weight of the bobbin.

For use in bobbins of the full-range and mid/treble speakers, it has been desired to reduce the weight of the bobbin by thinning a thickness thereof. However, when the thickness of the bobbin is too thin, a portion which is not wound around a coil becomes structurally weakened, and accordingly, a treble resonance and a vibration loss may occur.

SUMMARY OF THE INVENTION

The present inventions provides a voice coil and a speaker that can reinforce a portion of a bobbin that is not wound around a coil, have a high propagation velocity, are lightweight and strong, and are capable of reducing the vibration loss.

An aspect of the present invention inheres in a voice coil encompassing a cylindrical bobbin formed of a first material; a coil which surrounds on an outer circumferential surface of the bobbin; and a plurality of reinforcement members formed of a material having a propagation speed faster than the first material and provided on the outer circumferential surface of the cylindrical bobbin.

Another aspect of the present invention inheres in a speaker encompassing a cylindrical bobbin formed of a first material; a coil which surrounds an edge of the cylindrical bobbin; a plurality of reinforcement members formed of a material having a sound propagation speed faster than the first material and provided on an outer circumferential surface of the cylindrical bobbin; a diaphragm connected to an another edge of the cylindrical bobbin; and a magnetic circuit magnetically connected to the coil.

DESCRIPTION OF THE PREFERRED EMBODIMENTS

Various embodiments of the present invention will be described with reference to the accompanying drawings. In the following descriptions, numerous details are set forth such as specific signal values, etc. to provide a thorough understanding of the present invention. However, it will be obvious to those skilled in the art that the present invention may be practiced without such specific details.

—Speaker—

Figure 1:
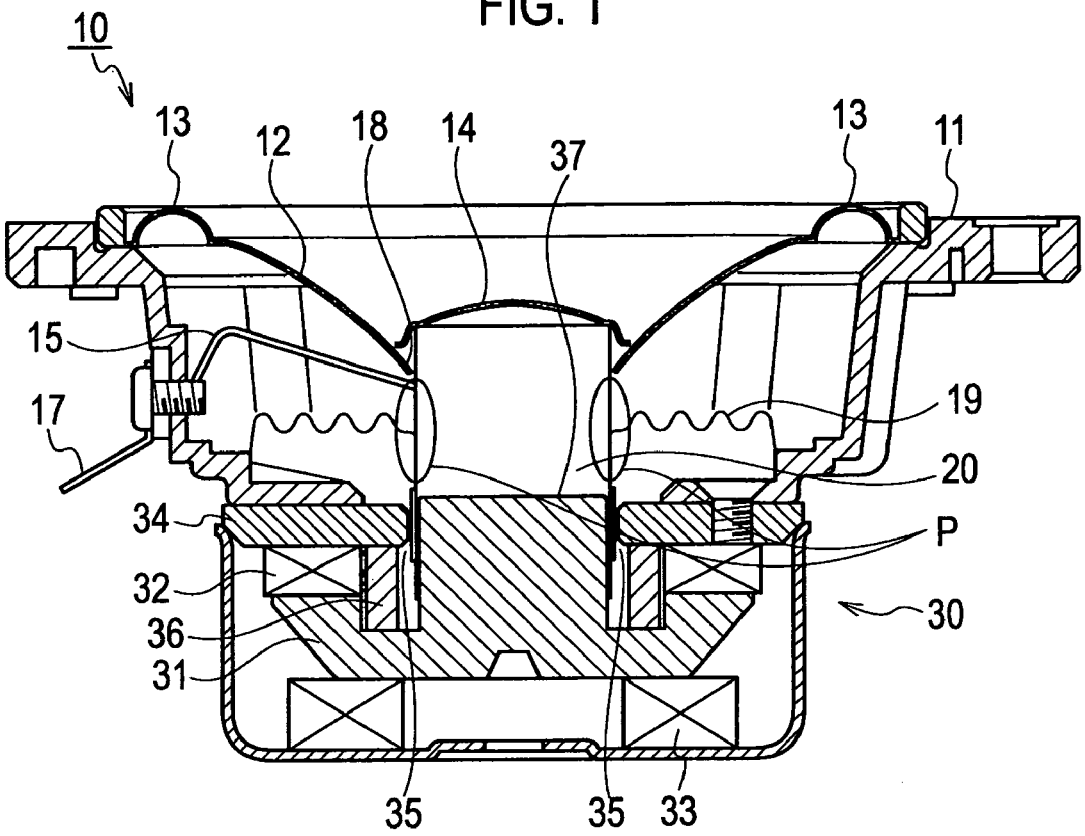
FIG. 1 is a perspective view illustrating a speaker according to an embodiment of the present invention.

As shown in FIG. 1, a speaker (a speaker unit 10) includes a diaphragm 12, a frame 11 that houses the diaphragm 12, a voice coil 20 connected to the diaphragm 12, and a magnetic circuit 30 magnetically connected to the voice coil 20 under the frame 11.

The diaphragm 12 has a cone (conical) shape in cross section, and an opening portion 18 is provided in a center thereof. A dust cap 14 for preventing intrusion of foreign objects into the voice coil 20 is attached onto the opening portion 18. A coupling member 13 such as a rubber edge is attached onto an entire outer circumferential portion of the diaphragm 12. The coupling member 13 is fixed to the frame 11, which houses the diaphragm 12 therein, while interposing a gasket or the like therebetween. An inner circumferential portion of the diaphragm 12 is adhered to an outer circumferential portion of the voice coil 20 by an adhesive or the like. A damper 19 is connected to the voice coil 20 and to an inside of the frame 11. A lead wire 15 is extracted from the voice coil 20. The lead wire 15 is connected to a terminal 17 attached onto the frame 11.

The magnetic circuit 30 includes a yoke 31 opposite to the frame 12, doughnut-like magnets 32 and 33 provided adjacent to the yoke 31, a top plate 34 disposed on the magnet 32, a copper cap 37 provided on a center pole of the yoke 31, and a short ring 36 disposed so as to surround a circumference of the center pole. The voice coil 20 is freely fitted into a magnetic gap 35 between the top plate 34 and the center pole of the yoke 31.

—Voice Coil—

Figure 2:
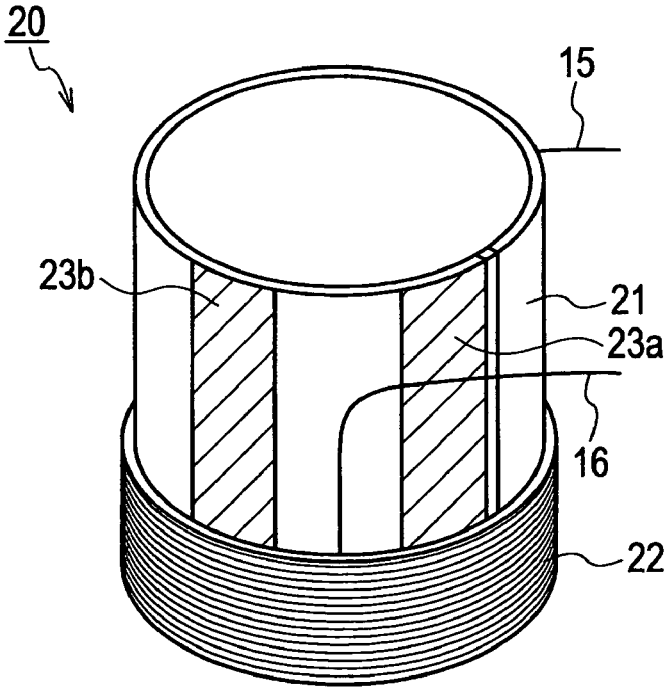
FIG. 2 is a perspective view illustrating a voice coil according to the embodiment of the present invention.

As shown in FIG. 2, the voice coil 20 includes a cylindrical bobbin 21, a coil 22 that surrounds an outer circumference of the bobbin 21, lead wires 15 and 16 which are extracted from the coil 22 and reinforcement members 23*a* and 23*b* which are provided on an outer circumferential surface of the bobbin 21.

The bobbin 21 is formed of a first material. The "first material" refers to an isotropic material in which a sound propagation speed is substantially equal in every direction in the material. In the present embodiment, the "first material" includes a single material made from papers such as Japanese paper and kraft paper, fiber-like materials such as aramid fiber, metals such as aluminum, plastics such as polyimide, and the like.

A thickness of the bobbin 21 can be properly determined according to types of speakers and materials for use. It is preferable that the thickness is set, for example, at approximately 0.03 mm to 0.20 mm if the bobbin 21 is a paper. If the thickness of the paper bobbin 21 is set over 0.20 mm, a specific gravity of the bobbin 21 against the diaphragm 12 becomes larger, and accordingly, a vibration loss may be increased. If the thickness of the paper bobbin 21 is set under 0.03 mm, the strength of the paper bobbin 21 falls short even if a plurality of reinforcement members 23*a*, 23*b*, . . . , as will hereinafter be described in detail, are provided, and accordingly, a faithful reproduction of a sound may be disturbed. In addition, a reinforcement member such as Japanese paper can be laminated onto an inner circumferential surface of the bobbin 21. A thickness of the Japanese paper can be properly determined so as not to interfere with lightweight of the bobbin.

As the coil 22, for example, a copper-made electric wire can be used. The coil 22 is wound to plural layers around the bobbin 21 in a horizontal direction of a page space of FIG. 2.

Figure 3:
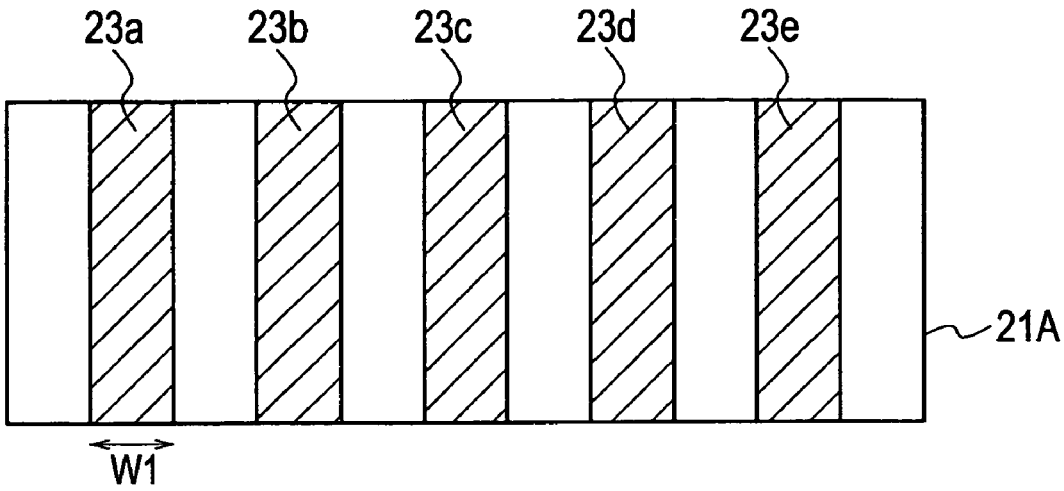
FIG. 3 is a plane view illustrating a method of manufacturing the voice coil according to the embodiment of the present invention.

As the reinforcement members 23*a* and 23*b*, materials which have a sound propagation speed faster than the first material may be used. For example, metals such as aluminum, copper, titanium and magnesium, aramid fiber and Japanese paper (paper mulberry, mitsumata shrub and gampi tree) can be used as the reinforcement members 23*a* and 23*b* if the bobbin 21 is a paper. As shown in FIG. 3, a plurality of strip-shaped reinforcement members 23*a*, 23*b*, 23*c*, 23*d* and 23*e* are laminated on the rectangular sheet 21A with an adhesive and the like. The reinforcement members 23*a*, 23*b*, 23*c*, 23*d* and 23*e* are provided at intervals and are respectively aligned along a shorter direction of the rectangular sheet 21A.

In the case of using a metal as the reinforcement members 23*a*-23*e*, it becomes less influenced by magnetic fields and a faithful reproduction of a sound may be obtained, if a strip width W1 (as shown in FIG. 3) of the reinforcement members 23*a*-23*e* are shortened. In addition, if the strip width W1 of the reinforcement members 23*a*-23*e* are too short, it becomes difficult to laminate the reinforcement members 23*a*-23*e* onto the sheet 21A and thus a product yield will be lowered. Accordingly, it is preferable that the strip widths W1 of the reinforcement member 23*a*-23*e* are set, for example, at approximately 1 mm to 10 mm. It is also preferable that a total width of widths W1 of the reinforcement members 23*a*-23*e* against a width of the bobbin 21 in the longitudinal direction may be set from 1/15 to 1/3.

The shapes of the reinforcement members 23*a* through 23*e* are not particularly limited. As shown in FIG. 3, a strip-shaped rectangular film may be laminated on the bobbin 21. Various shapes such as a triangle, an oval, a polygonal-shape may be used for the reinforcement members 23*a*-23*e*.

It is preferable that the thickness of the reinforcement members 23*a*-23*e* are thinned enough to reinforce a portion (portion P in FIG. 1) which is not wound around the coil 22 in consideration of a weight saving. As shown in FIG. 2, for example, an aluminum foil with a thickness of 0.012 mm to 0.1 mm can be used as the reinforcement members 23*a*-23*e*.

Figure 4:
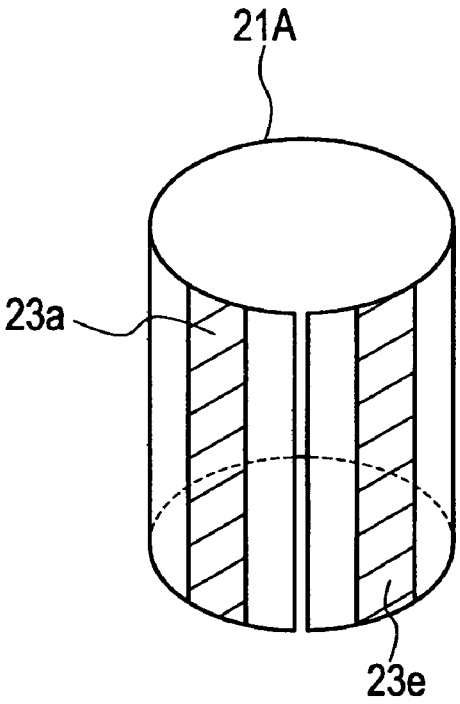
FIG. 4 is a perspective view illustrating a method of manufacturing the voice coil according to the embodiment of the present invention.

A method of fabricating the voice coil 21 as shown FIG. 2 is shown. As shown in FIG. 3, a rectangular sheet 21A is prepared. The reinforcement members 23*a*-23*e* are adhered to the rectangular sheet 21A by use of an adhesive and the like. As shown in FIG. 4, the sheet 21A is rolled to a cylindrical shape, whereby the bobbin 21 is fabricated. Then, as shown in FIG. 2, the coil 22 just needs to be wound around the bobbin 21 with a constant winding width and a constant number of layers, and the lead wires 15 and 16 just need to be extracted from the coil 22.

In accordance with the voice coil 20 according to the embodiment of the present invention, the reinforcement members 23*a*-23*e* that has a faster vibration propagation speed than the bobbin 21 are laminated on the bobbin 21 which is formed of the isotropic material (first material) by use of an adhesive and the like. Since the vibration propagation speed of the reinforcement members 23*a*-23*e* are faster than that of the bobbin 21, the voice coil 20 with high responsive properties of sounds can be obtained as compared with the conventional voice coil which is only formed of a single material.

Furthermore, the mechanical strength of the portion P which is not wound around the coil 22 will be enhanced since the reinforcement members 23*a*-23*e* are laminated at one end to another end of the cylindrical bobbin 32. Accordingly, a breakage due to the long-term operation will be prevented and thus, the voice coil 20 having a higher resistance characteristic can be fabricated. There is also another method of fabricating the voice coil according to the embodiment. For example, a piece of a large sheet from which dozens of sheets 21A can be cut out is prepared. The reinforcement members 23*a*-23*e* are laminated onto the large sheet and thereafter, the sheets 21A with predetermined size are cut out from the large paper on which the reinforcement members 23*a*-32*e* are laminated. It makes it possible to produce the voice coil in large quantities.

Moreover, since the strip-shaped reinforcement members 23*a*-23*e* are not laminated on an entire surface of the bobbin 21 but laminated in a direction substantially perpendicular to a winding direction of the coil at intervals therebetween, the influence of magnetic dumping can be suppressed even if a metal such as aluminum is used as the reinforcement members 23*a*-23*e*. Accordingly, vibrations of the voice coil 20 can be faithfully transmitted to the diaphragm 12.

In addition, in accordance with the speaker which includes the voice coil 20 according to the embodiment of the present invention, since the voice coil 20 is capable of transmitting vibrations faithfully to the diaphragm 12, the speaker that can reproduce sounds which have not been able to be expressed by the conventional speaker because of the vibration loss and the like can be realized.

(Modification)

Figure 5:
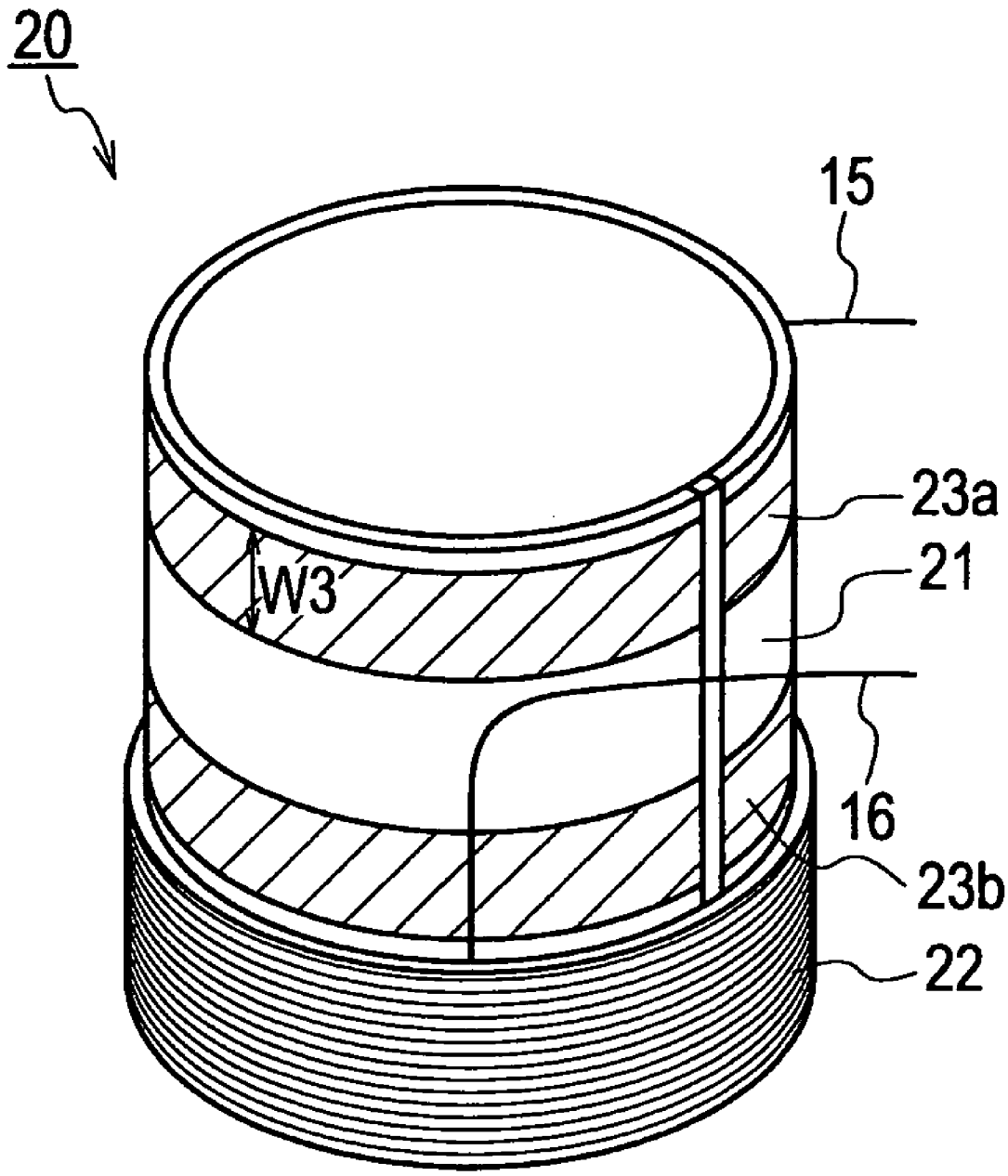
FIG. 5 is a perspective view illustrating a voice coil according to a modification of the present invention.

As shown in FIG. 5, a voice coil 20 according to a modification of the present invention is different from FIGS. 2-4 in that the reinforcement members 23*a* and 23*b*, that are provided on the outer circumferential surface of the bobbin, are laminated in a direction substantially horizontal to a winding direction of the coil 22 (in other words, the reinforcement members 23*a* and 23*b* are aligned along a same direction as a winding direction of the coil 22).

The reinforcement members 23*a* and 23*b* are provided on a potion of the outer circumferential surface on which the coil is not provided. Accordingly, the voice coil 20 is less influenced by a magnetic damping of the magnetic circuit 30 as shown in FIG. 1, even if the metal such as aluminum is used as the reinforcement members 23*a* and 23*b*. It makes it possible to prevent applying excess current to the coil 20 and thus, a faithful reproduction of a sound may be obtained.

The widths W3 of the reinforcement members 23*a*-23*b* are not particularly limited. However, if widths W3 of the reinforcement members are set too small, it may be difficult to laminate the reinforcement members 23*a*-23*e* on the sheet 21A and a production yield will be lowered. Accordingly, a ratio of a total of widths W3 of the reinforcement members 23*a* and 23*b* against a height of a bobbin 21 may be determined from 1/10 to 2/3.

Figure 6:
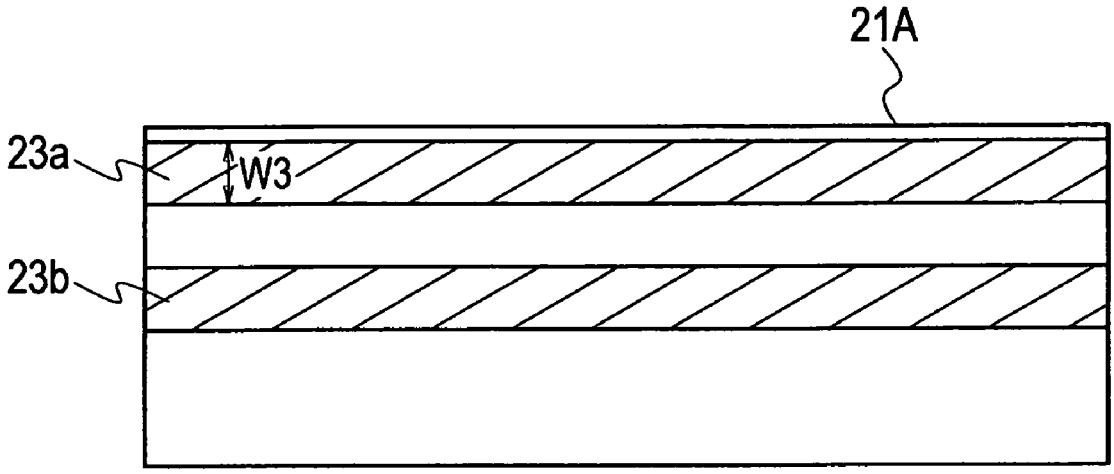
FIG. 6 is a plane view illustrating a method of manufacturing the voice coil according to the modification of the present invention.
Figure 7:
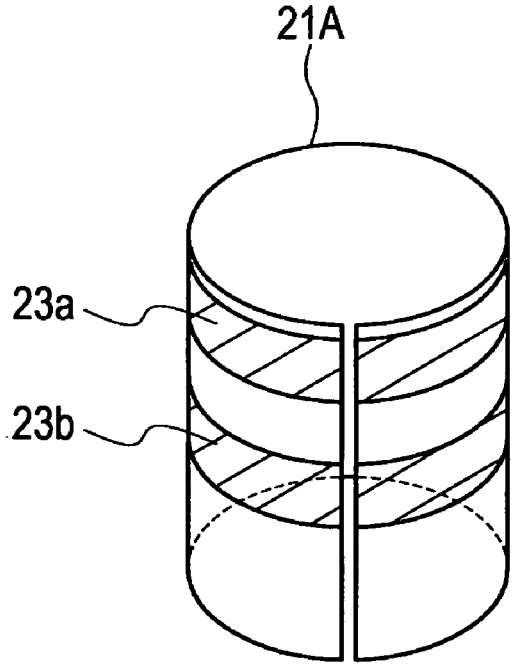
FIG. 7 is a perspective view illustrating a method of manufacturing the voice coil according to the modification of the present invention.

When producing the voice coil, as shown in FIG. 6, the rectangular sheet 21A is prepared. Then, the reinforcement members 23*a* and 23*b* are laminated on the sheet 21A to have a predetermined space and are aligned along a longitudinal direction of the sheet 21A. In this event, the reinforcement members 23*a* and 23*b* are provided not to occupy a portion on which the coil is wound. Thereafter, as shown in FIG. 7, the sheet 21A is rolled to a cylindrical shape, whereby the bobbin 21 is fabricated. Then, the coil just needs to be wound around the bobbin 21 with a constant winding width and a constant number of layers, and the lead wires just need to be extracted from the coil.

In accordance with the voice coil 20 according to the modification of the present invention, the reinforcement sheets 23*a*-23*e* are laminated in a direction substantially horizontal to the winding direction of the coil 22. The propagation speed of vibrations generated by a change of an acoustic current flowing through the coil transmitted to the reinforcement members 23*a*-23*e* is faster than the propagation speed of the vibrations of the bobbin 21. Therefore, it can be possible to obtain the voice coil 20 and the speaker using the voice coil 20 that can take advantage of the physical properties of each of materials that forms the voice coil 20 and have a large internal loss and higher propagation speed.

OTHER EMBODIMENTS

Additional advantages and modifications will readily occur to those skilled in the art. Therefore, the invention in its broader aspects is not limited to the specific details and representative embodiments shown and described herein.

For example, the reinforcement members 23*a*-23*e* as shown in FIG. 3 may be cut into a suitable shapes and sizes and may be selectively laminated onto a specific area of the bobbin that transmits vibrations faster than other areas is desired. For example, dot-shaped reinforcement members 23*a*-23*e* can be scattered on an entire portion of the sheet 21A.

The combinations of materials of the bobbin 21 and the reinforcement members 23*a*-23*e* can be properly determined. As a first example, the bobbin 21 may be kraft and the reinforcement members 23*a*-23*e* may be Japanese Paper. According to the first example, the voice coil that is strong and lightweight can be realized. In addition, materials with long fiber length such as paper mulberry, mitsumata shrub and gampi tree can be suitably used as the Japanese paper.

As a second example, the bobbin 21 may be kraft and the reinforcement members 23*a*-23*e* may be magnesium. Since kraft has a sound propagation speed of approximately 1900 m/s and magnesium has a sound propagation speed of approximately 4800 m/s, the propagation speed of vibrations can be changed between the bobbin 21 and the reinforcement members 23*a*-23*e*. According to the second example, weight saving will be also accomplished.

As a third example, the bobbin 21 may be kraft and the reinforcement members 23*a*-23*e* may be titanium (the sound propagation speed of titanium is approximately 4900 m/s). As a forth example, the bobbin 21 may be kraft and the reinforcement members 23*a*-23*e* may be copper. According to the third and forth examples, the voice coils which are strong and lightweight will be obtained.

As a fifth example, the bobbin 21 may be aramid fiber and the reinforcement members 23*a*-23*e* may be a metal. According to the fifth example, the mechanical strength of elements that forms the voice coil bobbin will be enhanced and bassy sounds can be faithfully reproduced. As a sixth example, since the bobbin 21 may be aluminum and the reinforcement members 23*a*-23*e* may be a metal that has higher propagation speed than the aluminum, the similar effect as the fifth example can be realized.

Various modifications may be made without departing from the spirit or scope of the general inventive concept as defined by the appended claims and their equivalents.

What is claimed is:

1. A voice coil comprising:

a cylindrical bobbin formed of a first material;

a coil which surrounds on an outer circumferential surface of the bobbin; and a plurality of reinforcement members formed of a material having a vibration propagation speed faster than the first material and provided on the outer circumferential surface of the cylindrical bobbin, wherein the reinforcement members are strip-shaped and are provided apart from each other on the outer circumferential surface of the cylindrical bobbin, each of the reinforcement members is aligned in a direction substantially perpendicular to a winding direction of the coil, and a ratio of a total of widths of the reinforcement members against a width of the cylindrical bobbin is set from 1/15 to 1/3, or wherein the reinforcement members are strip-shaped and are provided apart from each other on an area of the outer circumferential surface of the cylindrical bobbin other than an area on which the coil is wound, each of the reinforcement members is aligned in a same direction as a winding direction of the coil, and a ratio of a total of widths of the reinforcement members against a height of the cylindrical bobbin is set from 1/10 to 2/3.

2. The voice coil of claim 1, wherein the first material includes Japanese paper, kraft paper, aramid fiber, aluminum or polyimide.

3. The voice coil of claim 1, wherein the bobbin is a paper and has a thickness of 0.03 mm to 0.20 mm.

4. The voice coil of claim 1, wherein the reinforcement members are aluminum foil and have a thickness of 0.012 mm to 0.1 mm.

5. The voice coil of claim 1, wherein the reinforcement members include aluminum, copper, titanium, magnesium, aramid fiber or Japanese paper.

6. A speaker comprising:

a cylindrical bobbin formed of a first material;

a coil which surrounds an edge of the cylindrical bobbin;

a plurality of reinforcement members formed of a material having a vibration propagation speed faster than the first material and provided on an outer circumferential surface of the cylindrical bobbin;

a diaphragm connected to an another edge of the cylindrical bobbin; and a magnetic circuit magnetically connected to the coil, wherein the reinforcement members are strip-shaped and are provided apart from each other on the outer circumferential surface of the cylindrical bobbin, each of the reinforcement members is aligned in a direction substantially perpendicular to a winding direction of the coil, and a ratio of a total of widths of the reinforcement members against a width of the cylindrical bobbin is set from 1/15 to 1/3, or wherein the reinforcement members are strip-shaped and are provided apart from each other on an area of the outer circumferential surface of the cylindrical bobbin other than an area on which the coil is wound, each of the reinforcement members is aligned in a same direction as a winding direction of the coil, and a ratio of a total of widths of the reinforcement members against a height of the cylindrical bobbin is set from 1/10 to 2/3.

7. The speaker of claim 6, wherein the first material includes Japanese paper, kraft paper, aramid fiber, aluminum or polyimide.

8. The speaker of claim 6, wherein the bobbin is a paper and has a thickness of 0.03 mm to 0.20 mm.

9. The speaker of claim 6, wherein the reinforcement members are aluminum foil and have a thickness of 0.012 mm to 0.1 m.

10. The speaker of claim 6, wherein the reinforcement members include aluminum, copper, titanium, magnesium, aramid fiber or Japanese paper.

* * * * *